United States Patent [19]

Tolomay

[11] Patent Number: 4,796,649

[45] Date of Patent: Jan. 10, 1989

[54] ICE FISHING SHELTER

[76] Inventor: James E. Tolomay, P.O. Box 452, North Bend, Pa. 17760

[21] Appl. No.: 97,149

[22] Filed: Sep. 16, 1987

[51] Int. Cl.[4] ..... E04H 15/18

[52] U.S. Cl. ..... 135/102; 135/116; 135/901; 43/1; 52/DIG. 13

[58] Field of Search ..... 135/102, 116, 901, 100; 52/63, DIG. 13; 43/1

[56] References Cited

U.S. PATENT DOCUMENTS

| | | | |
|---|---|---|---|
| 2,546,588 | 3/1951 | Ellis | 135/116 |
| 3,696,472 | 10/1972 | Perina et al. | 52/DIG. 13 |
| 3,953,949 | 5/1976 | O'Sheeran | 135/116 |
| 4,055,030 | 10/1977 | Earnshaw | 135/102 |
| 4,311,159 | 1/1982 | Wunderlich | 135/100 |
| 4,438,940 | 3/1984 | Hunt | 135/901 |

FOREIGN PATENT DOCUMENTS

| | | | |
|---|---|---|---|
| 738294 | 10/1932 | France | 135/102 |
| 371740 | 12/1974 | Sweden | 52/DIG. 13 |

*Primary Examiner*—David A. Scherbel
*Assistant Examiner*—Caroline D. Dennison
*Attorney, Agent, or Firm*—Jerry T. Kearns

[57] ABSTRACT

A portable shelter for use by ice fisherman is formed from two curved hollow shell halves joined together by cooperating VELCRO flange portions. One shell half is provided with a semicircular integrally formed floor. One shell half may be provided with a hinged or slidable door, while the other shell half is provided with a hooded vent. The portable ice fishing shelter may be transported to the site of use by nesting one shell half within the other shell half and towing the shelter over the surface of a frozen body of water in this condition. Upon arrival at the site of use, the shell halves are assembled to form an igloo-like shelter.

1 Claim, 3 Drawing Sheets

ICE FISHING SHELTER

BACKGROUND OF THE INVENTION

1. Field of the Invention

The present invention relates to ice fishing shelters, and more particularly pertains to a new and improved portable igloo-like ice fishing shelter. Thousands of fisherman engage in the sport of ice fishing. Ice fishing is conducted by cutting a hole through the frozen surface of a body of water. A baited hook is then lowered into the water through this hole for purposes of catching fish. While ice fishing, a fisherman is deprived of any natural shelter from the cold and wind because there are no trees or hills on the frozen surface of a body of water. To enable the fisherman to remain warm and relatively comfortable, the present invention provides a portable igloo-like ice fishing shelter for use on the frozen surface of a body of water.

2. Description of the Prior Art

Various types of ice fishing shelters are known in the prior art. A typical example of such an ice fishing shelter is to be found in U.S. Pat. No. Des. 69,762, which issued to J. Kurowski on Mar. 23, 1926. This patent discloses a curved hollow shelter. U.S. Pat. No. 3,173,436, which issued to W. Peters on Mar. 16, 1965, discloses a collapsible ice fishing shelter. This shelter is constructed from a frame section having two rigid walls made of thin plywood which are hingedly connected to fold into a transportable suitcase-like package. The remaining two walls of the shelter, as well as the top of the shelter, are formed by a flexible plastic sheet which is preferably transparent or translucent to admit light to the interior. A generally triangular seat is provided which fits in the juncture between the two plywood sections when they are folded into a right angular relationship. A pair of floor panels are provided which may rest upon the surface of the ice to keep the feet of the fisherman from the cold surface of the ice. U.S. Pat. No. Des. 237,964, which issued to R. Choponis on Dec. 9, 1975, discloses an ice fishing shelter constructed of curved sections and resembling an igloo. A roof vent and a covered door are provided. U.S. Pat. No. Des. 251,503, which issued to R. Truitt on Apr. 3, 1979, discloses a portable shelter constructed from a plurality of panels mounted on a frame. The portable shelter is provided with a hinged door. U.S. Pat. No. Des. 261,682, which issued to S. Hoover on Nov. 3, 1981, discloses a density measurement enclosure. The enclosure has a hemispherical roof and is provided with a door. U.S. Pat. No. 4,311,159, which issued to F. Wunderlich on Jan. 19, 1982, discloses a portable tent shelter which is supported by three flexible support members, two of which extend around opposite peripheral edges of the shelter and the third of which provides vertical support to the shelter center. Each of the flexible support members is formed from a plurality of segments which are connected on one side by a reinforcing tape and on the other side by elastic material in order that the supports can flex in one direction. The ends of the three flexible supports are attached to brackets disposed on opposite sides of the shelter and held to the ground by stakes or pins. By removing one of the brackets, the flexible supports are allowed to extend from the shelter material and the entire shelter can be rolled up into a compact form for storage or transportation. U.S. Pat. No. 4,554,937, which issued to D. Irwin on Nov. 26, 1985, discloses a portable free-standing shelter for hunters of a generally frusto-conical configuration which has a base and upwardly inclined sidewalls terminating in an open top. The sidewalls are defined by a plurality of panels of generally triangular or trapezoidal configuration having top and bottom edges connected by upwardly convergent opposite sides. Adjacent panels are hinged together in articulated relation so that the bottom edges of the panels define the base of the shelter and the top edges of the panels define the open top thereof. The connected panels may be arranged in various configurations, including a substantially open shelter or screen, or a closed or partially closed shelter as desired.

While the above mentioned devices are suited for their intended usage, none of these devices disclose a portable igloo-like ice fishing shelter constructed of a pair of hollow mating shell halves. Further, none of the aforesaid shelters utilize mating shell halves joined by cooperating VELCRO flanges. Additionally, none of the previously mentioned portable shelters disclose the use of two mating shell halves, one of which is provided with an integrally formed floor and the other of which is formed with an open bottom portion. Inasmuch as the art is relatively crowded with respect to these various types of ice fishing shelters, it can be appreciated that there is a continuing need for and interest in improvements to such ice fishing shelters, and in this respect, the present invention addresses this need and interest.

SUMMARY OF THE INVENTION

In view of the foregoing disadvantages inherent in the known types of ice fishing shelters now present in the prior art, the present invention provides an improved ice fishing shelter. As such, the general purpose of the present invention, which will be described subsequently in greater detail, is to provide a new and improved ice fishing shelter which has all the advantages of the prior art ice fishing shelters and none of the disadvantages.

To attain this, a representative embodiment of the concepts of the present invention is illustrated in the drawings and makes use of two curved hollow mating shell halves, one of which is provided with an integrally formed floor portion, and the other of which is provided with an open bottom portion. Another feature contemplated by the present invention is the provision of mating flanges on each of the shell halves, the flanges provided with VELCRO type fasteners. An additional feature of the present invention is the use of shell halves configured so that, during storage and transportation, one shell half may be nested within the other shell half. Other features utilized in the preferred embodiment of the present invention include a hooded vent opening and a hinged door formed in the shell halves.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly form a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ice fishing shelter which has all the advantages of the prior art ice fishing shelters and none of the disadvantages.

It is another object of the present invention to provide a new and improved ice fishing shelter which may be easily and efficiently manufactured and marketed.

It is a further object of the present invention to provide a new and improved ice fishing shelter which is of a durable and reliable construction.

An even further object of the present invention is to provide a new and improved ice fishing shelter which is susceptible of a low cost of manufacture with regard to both materials and labor, and which accordingly is then susceptible of low prices of sale to the consuming public, thereby making such ice fishing shelters economically available to the buying public.

Still yet another object of the present invention is to provide a new and improved ice fishing shelter which provides in the apparatuses and methods of the prior art some of the advantages thereof, while simultaneously overcoming some of the disadvantages normally associated therewith.

Still another object of the present invention is to provide a new and improved ice fishing shelter which is formed from curved hollow shell halves which may be nested together for storage and transportation.

Yet another object of the present invention is to provide a new and improved ice fishing shelter which utilizes two curved hollow shell halves, one of which is provided with an integrally formed floor and the other of which is provided with an open bottom portion.

Even still another object of the present invention is to provide a new and improved ice fishing shelter which utilizes two curved hollow shell halves joined by VELCRO fasteners on mating flange portions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
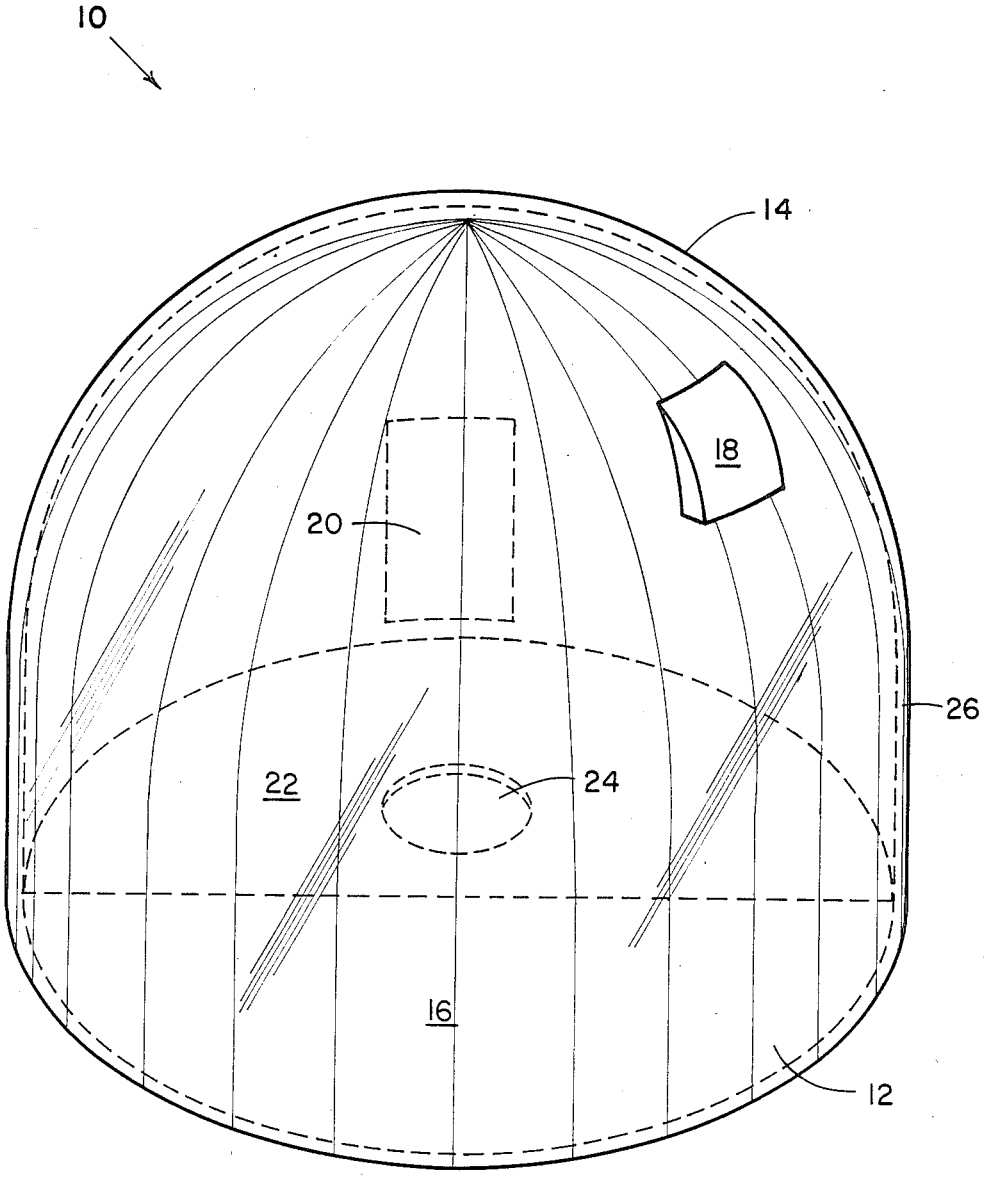
FIG. 1 is a perspective view of the portable igloo-like ice fishing shelter of the present invention.

With reference now to the drawings, and in particular to FIG. 1 thereof, a new and improved ice fishing shelter embodying the principles and concepts of the present invention and generally designated by the reference numeral 10 will be described.

More specifically, it will be noted that the first embodiment 10 of the invention includes a first curved hollow shell half 12 which is connected to a second hollow curved shell half 14 along a flange 26 provided with a VELCRO fastening strip. Curved shell half 14 has a mating flange 28 provided with a cooperating VELCRO fastening strip. The first hollow curved shell half 12 is provided with an integrally moulded semicircular floor 16. The hollow curved shell half 14 has an open bottom portion. Thus, the interior of the shell half 14 allows access to the frozen surface 22 of a body of water. A hole 24 may then be cut into the surface 22 to obtain access for ice fishing. The shell half 14 is provided with a hinged door 20 while the shell half 16 is provided with a hooded vent 18.

Figure 2:
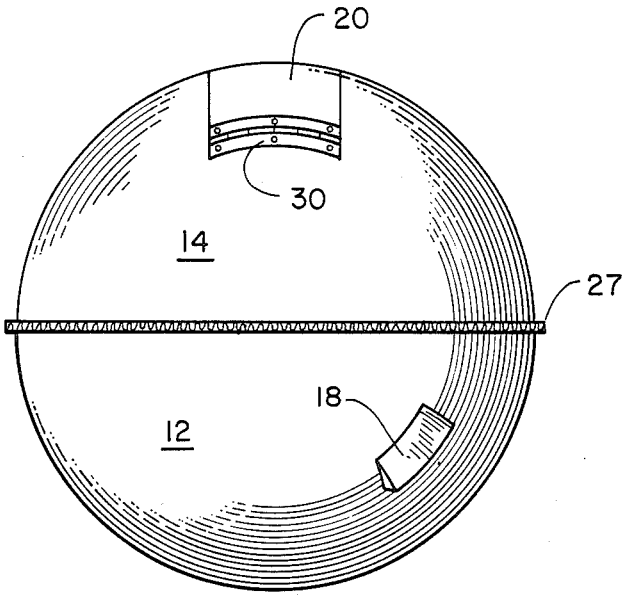
FIG. 2 is a top plan view of the ice fishing shelter of the present invention.

With reference now to FIG. 2, the mating flanges of the shell halves 12 and 14 are engaged to form a VELCRO joint 27. The hooded vent 18 of shell half 12 may be seen. It can now be understood that the hooded vent 18 prevents the entrance of rain into the interior of the ice fishing shelter 10 of the present invention, while at the same time providing ventilation. It may also be seen that the arcuate hinged door 20 is connected to the shell half 14 for movement between open and closed positions by a hinge 30.

Figure 3:
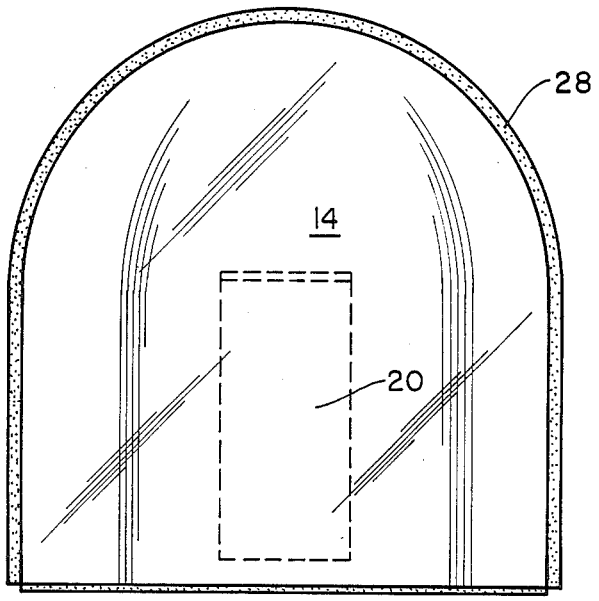
FIG. 3 is a perspective view of one of the curved hollow shell halves of the ice fishing shelter of the present invention.

With reference now to FIG. 3, a side view of the shell half 14, disassembled from the shell half 12, is provided. It will be noted that the shell half 14 is provided with a peripheral flange 28 provided with a VELCRO fastening strip.

Figure 4:
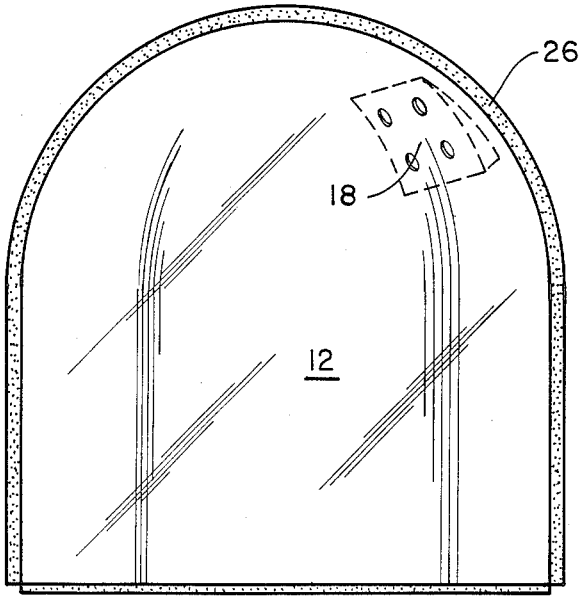
FIG. 4 is a perspective view of the other curved hollow shell half of the ice fishing shelter of the present invention.

With reference now to FIG. 4, a side view of the shell half 12, disassembled from the shell half 14, is provided. It will be noted that the shell half 12 is provided with a peripheral flange 26 provided with a VELCRO fastening strip.

Figure 5:
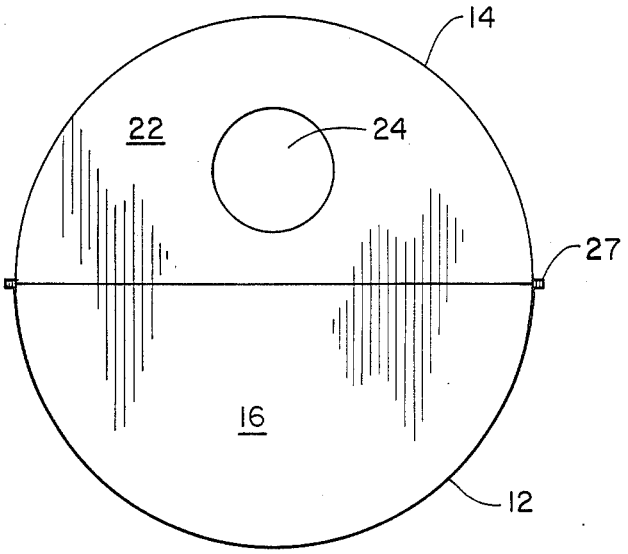
FIG. 5 is a bottom view of the ice fishing shelter of the present invention, looking upwardly through the frozen surface of a body of water.

With reference now to FIG. 5, a fish eye view of the portable ice fishing 10 of the present invention as looking upwards through the frozen surface 22 of a body of water is provided. The shell half 14 is provided with an open bottom portion. Thus, the frozen surface of a body of water is in direct contact with interior of the shell half 14. This allows access to a hole 24 cut through the frozen surface 22 of the body of water for conducting ice fishing. The mating shell half 12 is provided with a semi circular floor 16 integrally moulded therewith. The shell halves 12 and 14 are connected together along a VELCRO joint 27 by the previously mentioned flanges 26 and 28. Thus, it may now be understood, that a fisherman may sit within the interior of the shell half 12 with his feet protected from the cold frozen surface 22 of the body of water by the semicircular floor 16. The weight of the fisherman on the floor 16 also serves to stabilize the ice fishing shelter 10 of the present invention in position against the force of any prevailing winds.

The manner of use and transport of the ice fishing shelter 10 of the present invention will now be described. With the shell halves 12 and 14 in a disassembled condition, the shell half 14 is nested within the shell half 12. This allows the ice fishing shelter 10 of the present invention to be easily transported in the back of a truck to the edge of a frozen body of water. At this time, the nested shell halves 12 and 14 may be removed from the truck and skidded along the frozen surface 22 of the body of water by attaching a tow rope to the shell half 12. Upon arrival at the desired fishing site, the shell halves 12 and 14 are stood upright and connected together by engagement of flanges 26 and 28 to form a VELCRO joint 27, as shown in FIG. 2. The fisherman then enters the ice fishing shelter 10 by opening the hinged door 20. A hole 24 is then cut through the frozen surface 22 of the body of water. A suitable bench or stool is placed upon the semi circular floor 16 of the shell half 12. The fisherman may then sit upon the stool with his feet protected from contact with the frozen surface 22 of the body of water. Ventilation for the respiration of the fisherman is provided by the hooded vent opening 18. This hooded vent may also provide ventilation for a portable lantern or heating device. When the ice fishing is completed, the shell halves 12 and 14 are then disassembled and nested together, and transported to a storage location.

The shell halves 12 and 14 may be constructed of reinforced moulded fiberglass or plastic, and may be provided with a central laminated layer of insulation or an interior insulation layer of styrofoam or other insulating material.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved igloo shaped ice fishing shelter, comprising:

a first curved hollow molded shell half having a first arcuate peripheral flange;

a second curved hollow molded shell half having a second arcuate peripheral flange;

said first and second peripheral flanges having cooperating VELCRO fastening strips, whereby said first and second shell halves may be assembled to form an igloo shaped ice fishing shelter;

a semicircular floor integrally molded on said first shell half;

said second shell half having an open bottom portion;

a hooded ventilation opening formed in said first shell half;

an arcuate hinged door having curvature in two perpendicular directions formed in said second shell half;

said first and second shell halves formed from reinforced fiberglass; and said first and second shell halves provided with a layer of insulation.

* * * * *